US007040275B2

(12) United States Patent
Ohta et al.

(10) Patent No.: US 7,040,275 B2
(45) Date of Patent: May 9, 2006

(54) OIL PAN STRUCTURE

(75) Inventors: Yasuki Ohta, Nagoya (JP); Masatoshi Hada, Nagoya (JP); Hiroyuki Kurokawa, Aichi-ken (JP)

(73) Assignee: Aichi Machine Industry Co., Ltd., Nagoya (JP)

( * ) Notice: Subject to any disclaimer, the term of this patent is extended or adjusted under 35 U.S.C. 154(b) by 0 days.

(21) Appl. No.: 10/969,211

(22) Filed: Oct. 21, 2004

(65) Prior Publication Data

US 2005/0081815 A1 Apr. 21, 2005

(30) Foreign Application Priority Data

Oct. 21, 2003 (JP) ..... 2003-361157

(51) Int. Cl.
*F01M 1/02* (2006.01)

(52) U.S. Cl. ..... 123/195 C; 123/196 R

(58) Field of Classification Search ..... 123/196 R, 123/195 C, 198 C, 196 W; 184/106, 6.13, 184/6.5
See application file for complete search history.

(56) References Cited

U.S. PATENT DOCUMENTS

| | | | | |
|---|---|---|---|---|
| 5,653,205 | A * | 8/1997 | Ozeki | 123/195 C |
| 5,901,679 | A * | 5/1999 | Tanaka et al. | 123/195 C |
| 6,079,383 | A * | 6/2000 | Shirai et al. | 123/192.2 |
| 6,705,270 | B1 * | 3/2004 | Rau et al. | 123/195 C |

FOREIGN PATENT DOCUMENTS

| | | | |
|---|---|---|---|
| JP | 05332113 | A * | 12/1993 |
| KR | 2001065987 | A * | 7/2001 |

* cited by examiner

*Primary Examiner*—Henry C. Yuen
*Assistant Examiner*—Hyder Ali
(74) *Attorney, Agent, or Firm*—Dennison, Schultz, Dougherty & MacDonald

(57) ABSTRACT

An oil pan (6) is mounted to a lower surface of a cylinder block (1) in order to reserve an oil. An oil pump housing (7) is cast integrally with the inner side of the right side surface (6*a*) of the oil pan (6). A rib (14) is formed in order to connect the right side surface (6*a*) and a left side surface (6*b*) of the oil pan (6).

8 Claims, 7 Drawing Sheets

OIL PAN STRUCTURE

BACKGROUND OF THE INVENTION

1. Field of the Invention

The present invention relates to a structure of an oil pan of an internal combustion engine.

2. Description of the Related Art

Conventionally, as a technique for improving a mounting rigidity and a mounting stability of an oil pump to an engine, for example, there has been proposed a technique disclosed in Japanese Unexamined Patent Publication No. 2002-339712.

In the conventional technique, an oil pump is mounted to a bearing cap provided in a lower surface of a cylinder block by a bolt, as well as to the cylinder block, whereby a mounting rigidity and a mounting stability are improved. However, in the conventional structure, since the oil pump is mounted as an independent structure to the cylinder block, there has been a problem that the weight increases.

Further, because an oil pump attachment portion is necessary to be provided in a cylinder block, there has been problems, such as problems that the configuration is complicated, and a casting property of the cylinder block is deteriorated.

SUMMARY OF THE INVENTION

The present invention is made by taking the problems in the conventional technique mentioned above into consideration, and it is an object of the present invention to make a cylinder block compact, and to reduce weight of the cylinder block and the like.

In accordance with a first aspect of the present invention, there is provided a structure of an oil pan which is mounted to a lower surface of a cylinder block in order to reserve an oil therewithin. In this structure, an oil pump housing is cast integrally with the oil pan.

In accordance with a second aspect of the present invention, the oil pan structure further includes an oil pump driving means that is disposed at a higher level than an oil surface reserved within the oil pan or is submerged within the oil.

In accordance with a third aspect of the present invention, the oil pump housing is integrally formed with an inner side of a side surface located on the side of one end in a width direction of the oil pan, a rib is provided to connect the side surface located on the side of one end and integrally formed with the oil pump housing to a side surface located on the side of the other end, the rib separates an inner side of the oil pan from an outer side arrangement chamber in which the oil pump driving means is disposed, and an opening for communicating the arrangement chamber with the inner side of the oil pan is formed in a lower portion of the rib.

In accordance with a fourth aspect of the present invention, an upper surface of the rib includes an inclined surface inclined downwardly from the side of the arrangement chamber toward the inner side of the oil pan.

In accordance with a fifth aspect of the present invention, the upper surface of the rib further includes a visor-like portion inclined upward to extend toward the arrangement chamber.

In accordance with a sixth aspect of the present invention, the oil pan is divided into an upper oil pan and a lower oil pan, and the oil pump housing is integrally formed with the upper oil pan.

In accordance with the present invention, since the oil pump housing is integrally formed with the oil pan by casting, it is not necessary to mount the oil pump to the cylinder block as in the conventional structure, and it is not necessary that the oil pump attachment portion is provided in the cylinder block. Accordingly, it is possible to make the cylinder block compact, to reduce the weight of the cylinder block, and to increase the rigidity of the cylinder block.

Further, since it is not necessary to mount the oil pump independently, a freedom of layout for mounting an auxiliary machine, such as an alternator or the like can be improved.

Further, with the arrangement in which the oil pump driving means is disposed at the higher level than the oil surface reserved within the oil pan or is submersed within the oil, it is possible to prevent the oil from bubbling due to an oil agitation by the oil pump driving means, and this leads to reliably prevent an air from being mixed into the oil to lower the discharging performance of the oil pump.

Further, with the arrangement in which the oil pump housing is integrally formed with an inner side of a side surface located on the side of one end in a width direction of the oil pan, a rib is provided to connect the side surface located on the side of one end and integrally formed with the oil pump housing to a side surface located on the side of the other end, the rib separates an inner side of the oil pan from an outer side arrangement chamber in which the oil pump driving means is disposed, and an opening for communicating the arrangement chamber with the inner side of the oil pan is formed in a lower portion of the rib, it is possible that the rib reliably prevents the oil pan and the oil pump housing from being deformed, the oil lubricating a timing chain and reaching the lower portion of the arrangement chamber can appropriately flow from into the inner side of the oil pan via the opening, and the oil is not retained within the arrangement chamber.

Further, with the arrangement in which an upper surface of the rib includes an inclined surface inclined downwardly from the side of the arrangement chamber toward the inner side of the oil pan, the oil lubricating the timing chain and dropping down to the lower portion of the arrangement chamber does not enter the side of the oil pump driving means, and can reliably flow into the inner side of the oil pan.

Further, with the arrangement in which the upper surface of the rib further includes a visor-like portion inclined upward to extend toward the arrangement chamber, it is possible to receive the oil lubricating the timing chain and dropping down to the lower portion of the arrangement chamber by the visor-like portion, to reliably flow the oil into the inner side of the oil pan, and to prevent the oil from entering the side of the oil pump driving means.

Further, with the arrangement in which the oil pan is divided into an upper oil pan and a lower oil pan, and the oil pump housing is integrally formed with the upper oil pan, the oil pump housing can be integrally formed as a cast product of an aluminum alloy together with the upper oil pan, and the lower oil pan can be produced as a press-molded product. Therefore, the manufacturing efficiency of the oil pan can be improved.

DESCRIPTION OF THE PREFERRED EMBODIMENT

A description will be given below with regard to an embodiment of the present invention with reference to the accompanying drawings.

Figure 1:
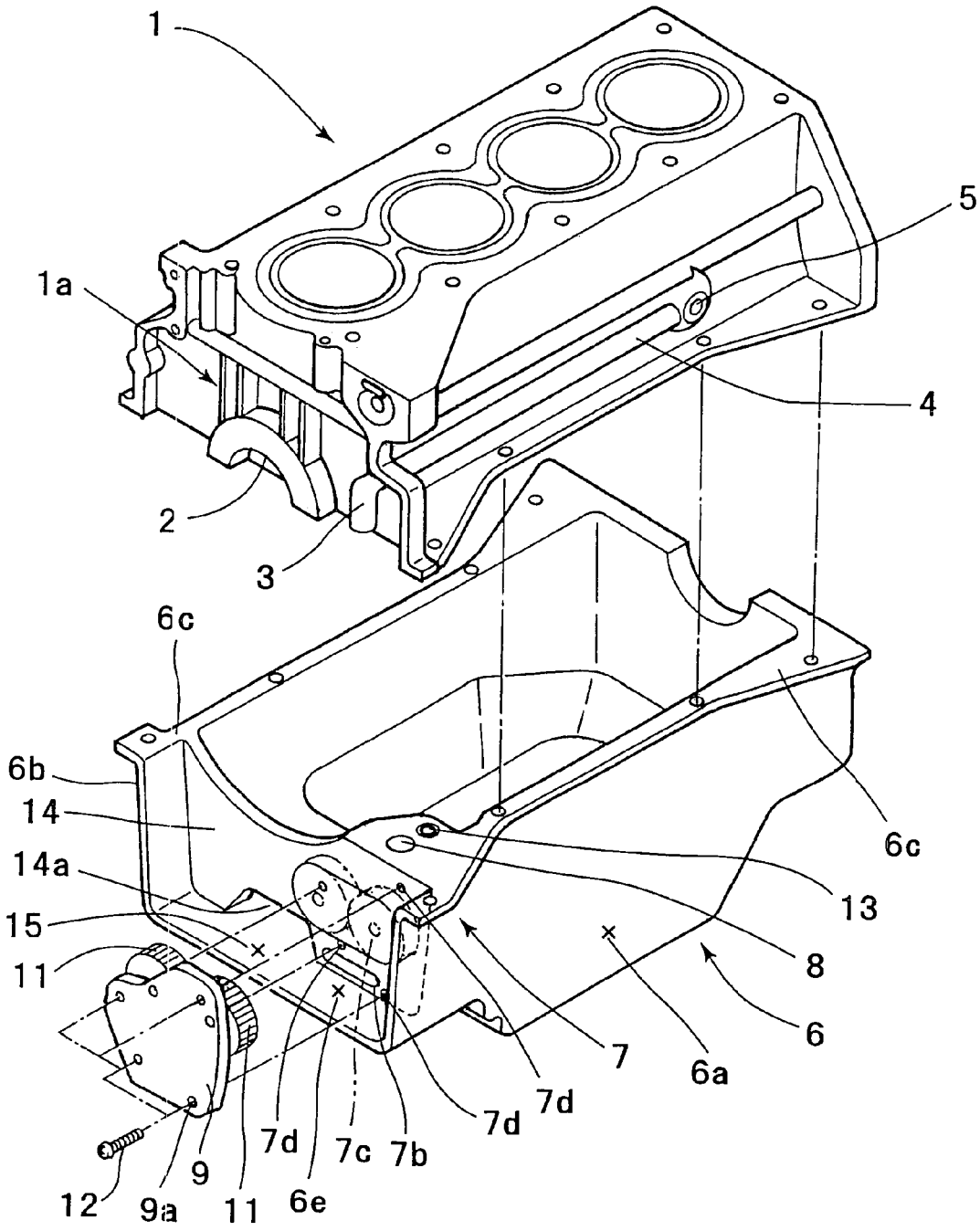
FIG. 1 is an exploded perspective view of a cylinder block, an oil pan and a mounting member thereof.

FIG. 1 is an exploded perspective schematic view of a cylinder block, an oil pan and a mounting member thereof.

Figure 2:
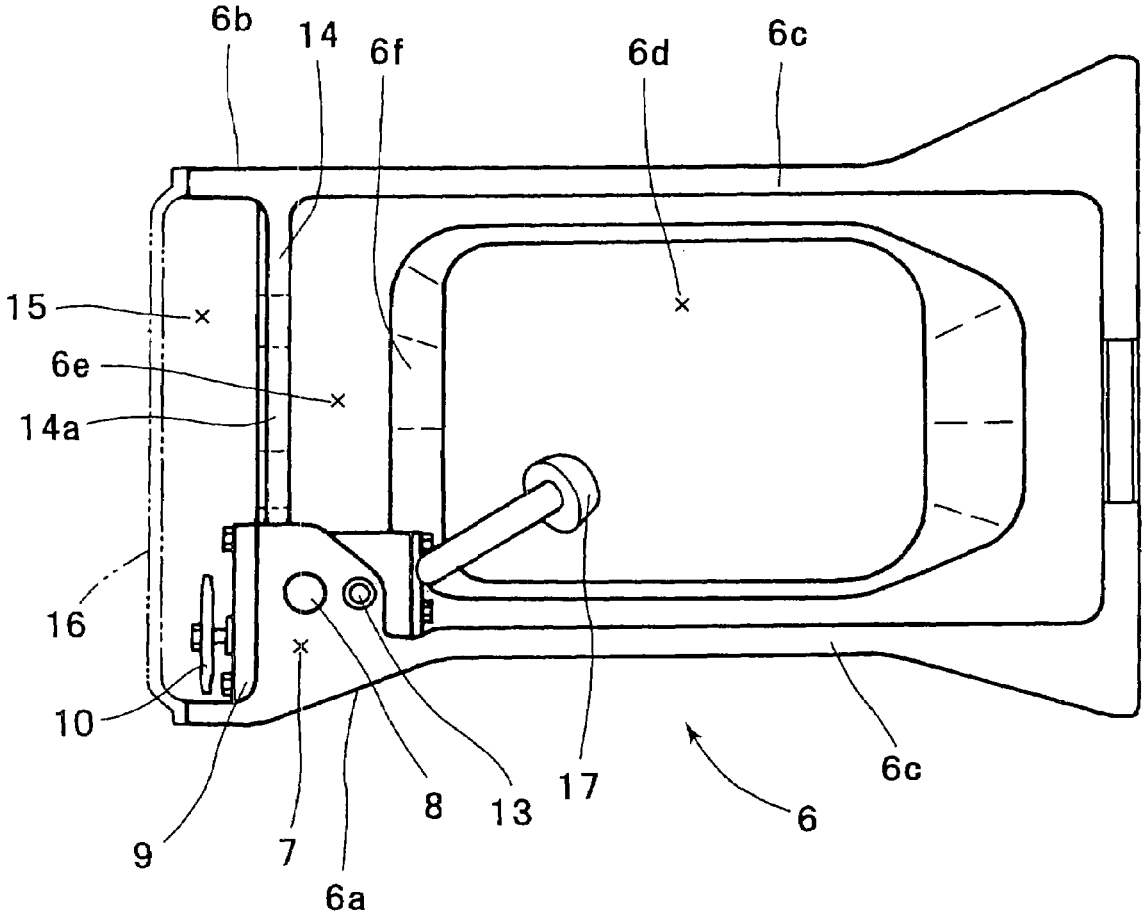
FIG. 2 is a plan view of the oil pan.

Further, FIG. 2 is a plan schematic view of the oil pan.

Figure 3:
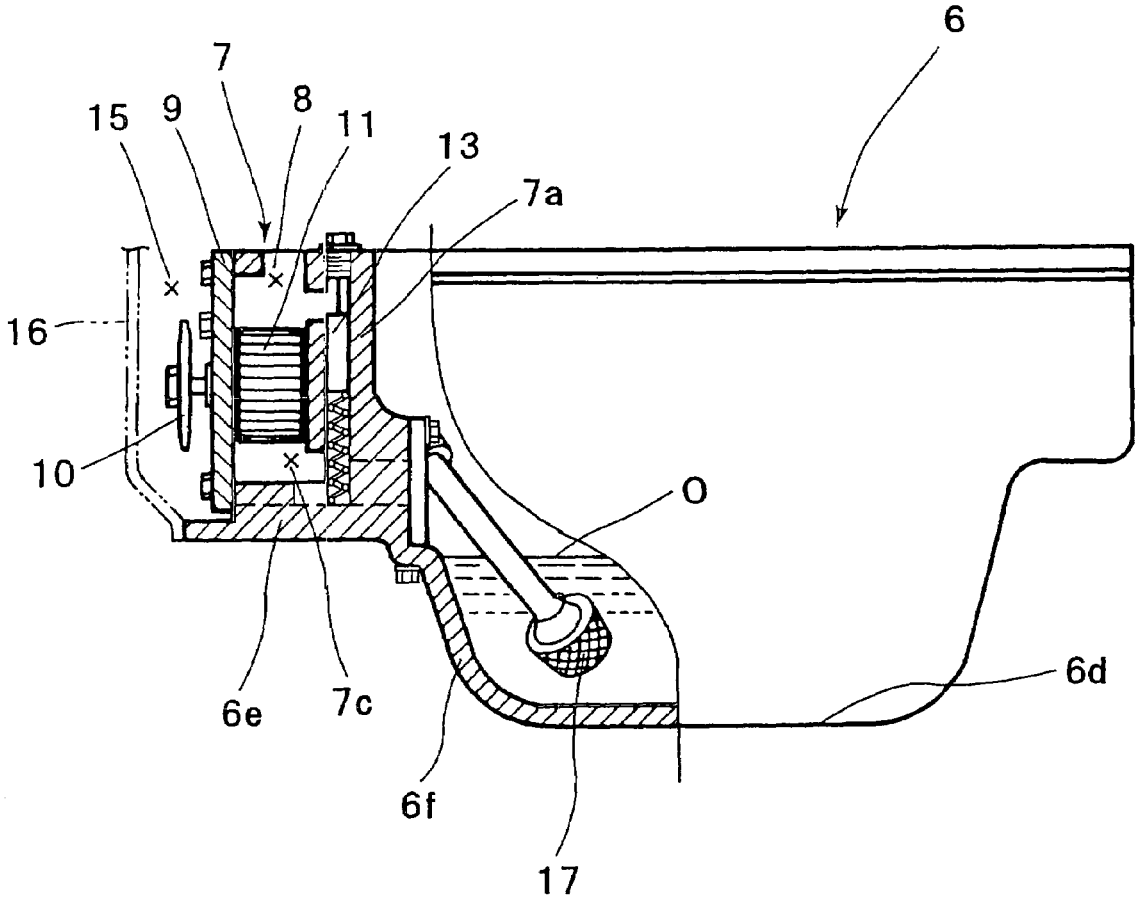
FIG. 3 is a partly broken side elevational view of the oil pan.

Further, FIG. 3 is a partly vertical cross sectional schematic view of the oil pan.

Figure 4:
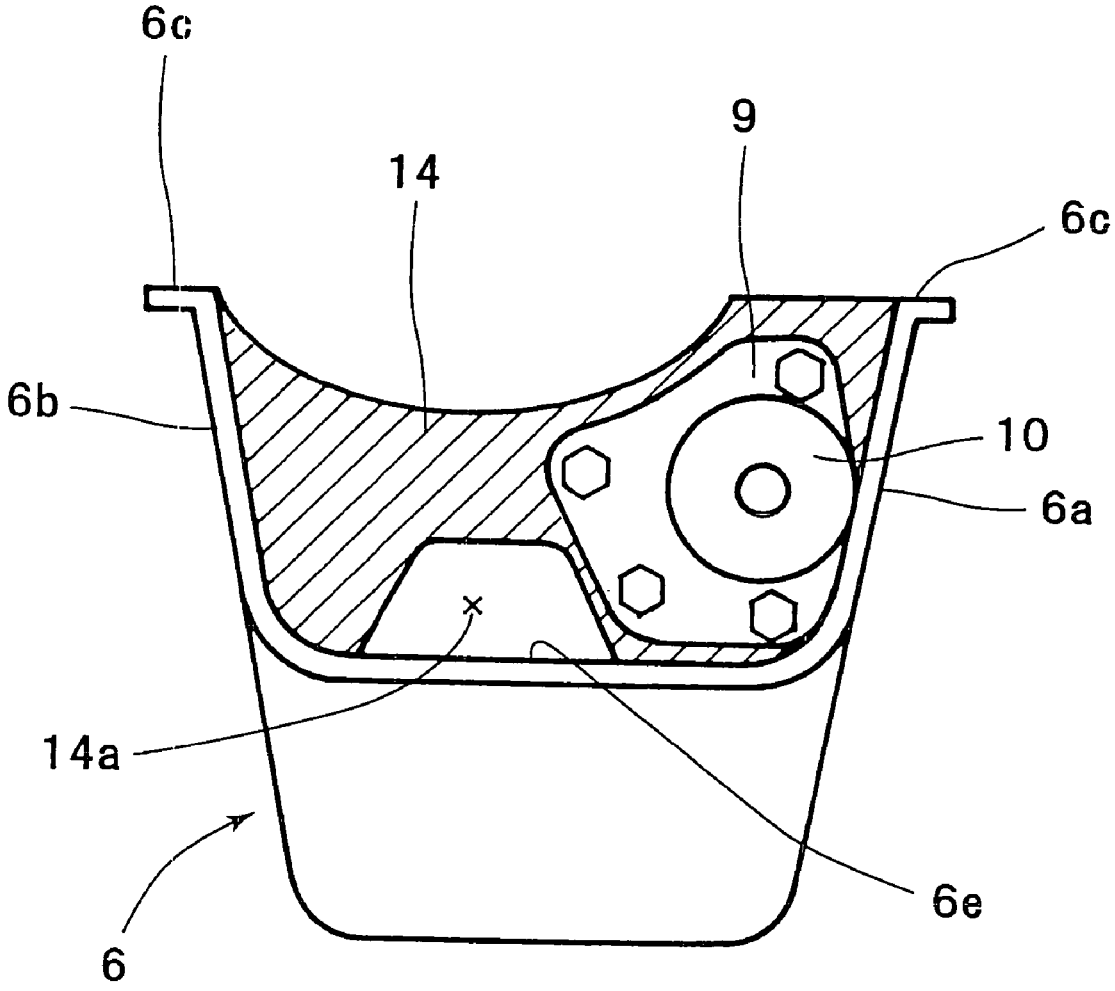
FIG. 4 is a front elevational view of the oil pan as seen from an arrangement chamber side.

Further, FIG. 4 is a front elevational schematic view of the oil pan as seen from an arrangement chamber side.

In these figures, a crank shaft bearing portion 2 is formed in a central portion of a lower surface of a cylinder block 1; a vertical oil passage 3 is formed to extend along a right side surface in an upward direction from the lower surface in an upright manner; a horizontal oil passage 4 is formed so as to extend in a horizontal direction from an upper end of the vertical oil passage 3; and it is constructed such that an oil is supplied to each of the portions of an engine through the oil passages 3 and 4.

Here, an oil filter mounting portion 5 for mounting an oil filter is disposed at an end portion of the horizontal oil passage 4.

An oil pan 6 is mounted to the lower surface of the cylinder block 1 and can reserve the oil therewithin. The oil pan 6 is configured to have a right side surface 6*a* and a left side surface 6*b* with regard to a width direction, which surfaces extend in an upright manner, and to have a mounting upper surface 6*c* formed on the upper side for mounting to the cylinder block 1 by a bolt.

Further, as shown in FIGS. 2 and 3, a deep bottom portion 6*d* is formed on the bottom side of the oil pan 6 so as to be depressed deeply downward, so that the oil can be reserved within the deep bottom portion 6*d*. The outer periphery of the deep bottom portion 6*d* is formed as a rising portion 6*f* extending in an upright manner, and a shallow bottom portion 6*e* is formed so as to extend substantially horizontally in a longitudinal direction from the upper end of the rising portion 6*f*.

An oil pump housing 7 is disposed inside of the right side surface 6*a* of the oil pan 6 and is formed integrally with and continuously from the right side surface 6*a*, and the oil pump housing 7 is configured such that a housing rising wall 7*a* is formed integrally with the shallow bottom surface 6*e* to extend in an upright manner in order to assemble therewithin a gear 11 or the like constituting the oil pump. An oil pump cover 9 can be mounted from the side of the cover mounting wall 7*b* by bolts 12, and a gear chamber 7*c* for accommodating the gear 11 is formed within the oil pump housing 7.

Here, an oil pump sprocket (i.e., an oil pump driving means) 10 is disposed on an outer side of the oil pump cover 9, and the gear 11 is disposed within the oil pump cover 9 so as to have the same axis as the axis of the oil pump sprocket (the oil pump driving means) 10.

In the state where the oil pump sprocket (the oil pump driving means) 10 and the gear 11 are previously mounted to the oil pump cover 9 as mentioned above, the oil pump cover 9 can be mounted to the cover mounting wall 7*b* of the oil pump housing 7 by the bolts 12 from the outer side.

To this end, screw holes 7*d* to which the bolts 12 can be fastened are formed in the cover mounting wall 7*b* of the oil pump housing 7.

As mentioned above, the oil pump can be structured by assembling the gear 11 together with the cover 9 within the oil pump housing 7.

Incidentally, a discharge port 8 is opened in the upper surface of the oil pump housing 7, and it is configured such that a relief valve 13 can be installed within the oil pump housing 7 from the upper surface by screws or the like.

A rib 14 is integrally formed with the right side surface 6*a* of the oil pan 6, which is integrated with the oil pump housing 7, and extends therefrom toward the left side surface 6*b*, so that the right side surface 6*a* and the left side surface 6*b* of the oil pan are connected by the rib 14 in order to improve the rigidity of the oil pan by the rib 14.

Incidentally, as shown in FIG. 4, the right side surface 6*a* and the left side surface 6*b* of the rib 14 are formed so as to have a height reaching the mounting upper surface 6*c* of the oil pan, a central portion of the upper surface of the rib 14 is formed in a curved shape, and an opening 14*a* is formed in a lower portion of the rib 14 to extend therethrough.

Incidentally, the opening 14*a* is opened in a position above the shallow bottom surface 6*e* of the oil pan 6; the rib 14 divides the upper surface side of the shallow bottom surface 6*e* of the oil pan 6 into an oil pan inner portion and an arrangement chamber 15 in which the outer side oil pump sprocket (i.e., an oil pump driving means) 10 is arranged; and the arrangement chamber 15 and the inner portion of the oil pan 6 are communicated by the opening 14*a*.

Incidentally, the oil pan 6, the oil pump housing 7 and the rib 14 are integrally cast at the same time that the oil pan 6 is cast by an aluminum alloy.

Incidentally, a chain case 16 is mounted to the outer side of the arrangement chamber 15 so as to form a covering lid. Thus, a timing chain (not shown) is arranged within the arrangement chamber 15.

More specifically, the timing chain for driving a cam shaft provided in the upper surface of the cylinder block 1 is arranged on the outer side of a side surface 1*a* close to the timing chain of the cylinder block 1. Further, a sprocket of the crank shaft and the oil pump sprocket (the oil pump driving means) 10 are connected by the chain, so that the oil pump sprocket (the oil pump driving means) 10 rotates as the crank shaft rotates, and that the gear 11 assembled within the oil pump housing 7 in turn rotates. As a result, the oil reserved in the deep bottom portion 6*d* of the oil pan is pumped via an oil strainer 17 so as to be discharged from a discharge port 8, and the oil is then supplied to each of the portions of the engine via the vertical oil passage 3 and the horizontal oil passage 4 mentioned above.

Accordingly, the timing chain disposed within the arrangement chamber 15 on the outer side of the rib 14 is also lubricated by the oil, and the oil that has lubricated the timing chain drops down into the lower portion of the arrangement chamber 15. However, the oil dropped down to the lower portion of the arrangement chamber 15 can be appropriately returned to the deep bottom portion 6*d* on the inner side of the oil pan via the opening 14*a* formed in the rib 14.

Figure 5:
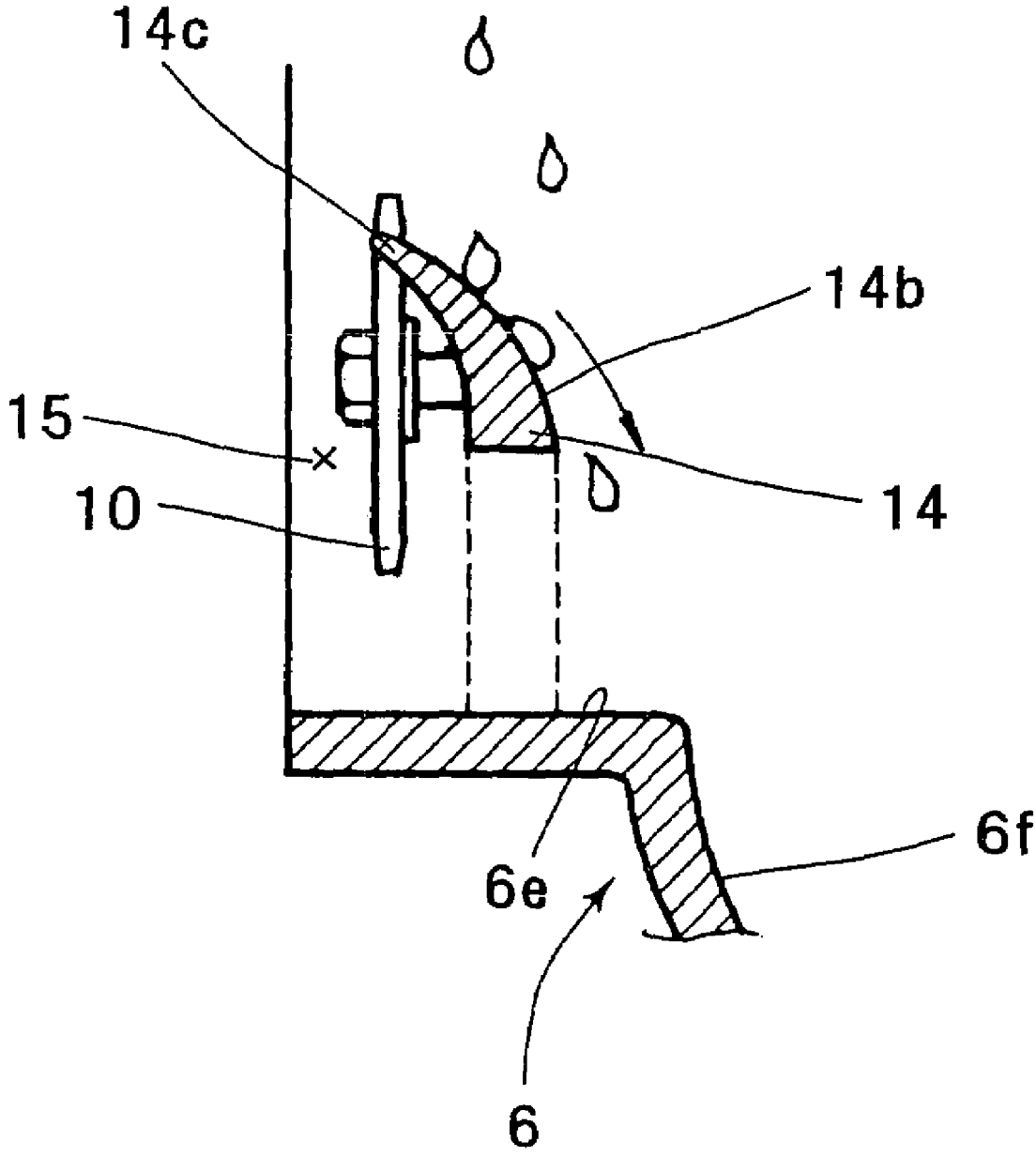
FIG. 5 is a vertical cross sectional view of an essential portion of an example of an inclined surface formed in an upper surface of a rib.
Figure 6:
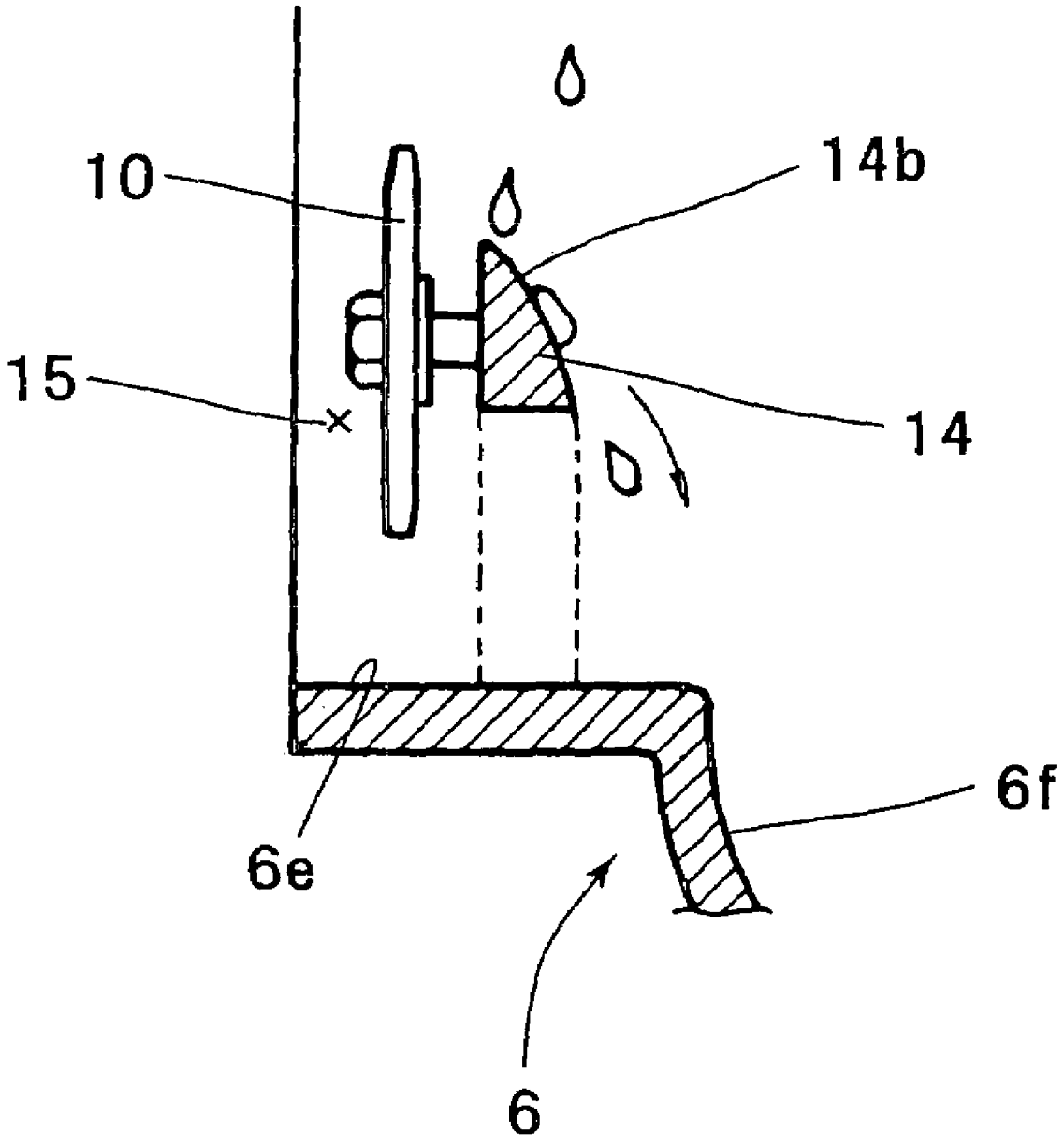
FIG. 6 is a vertical cross-sectional view of an essential portion of a modified embodiment of the inclined surface of the rib.

Incidentally, the upper surface of the rib 14 is configured as an inclined surface 14*b* as shown in FIGS. 5 and 6.

In FIG. 5, the upper surface of the rib 14 has an inclined surface 14*b* curved and inclined downward toward the inner side of the oil pan from the side of the arrangement chamber 15, and the oil dropping down within the arrangement chamber 15 can be received by the inclined surface 14*b* and can appropriately flow downward into the inner side of the rib 14.

Incidentally, as shown in FIG. 5, an a visor-like portion 14*c* extends toward the side of the arrangement chamber 15 is continuously formed on an upper end of the inclined surface 14*b*. Because the visor-like portion 14*c* extends toward the arrangement chamber 15, it is possible to more securely receive the oil dropping down within the arrangement chamber 15 in order to return the oil to the inner portion of the oil pan 6. Therefore, due to the incorporation of the visor-like portion 14*a*, it is possible to reduce an amount of the oil flowing down toward the oil pump sprocket (the oil pump driving means) 10.

When the oil pump sprocket (the oil pump driving means) 10 arranged in the lower portion within the arrangement chamber 15 rotates and agitates the oil, the air may be mixed into the oil, and the discharging performance of the oil pump may be lowered. Because the visor-like portion 14*c* and the inclined surface 14*b* mentioned above are provided in the upper surface of the rib 14, the oil may be prevented from being retained in the lower portion side of the arrangement chamber 15.

In case of an embodiment shown in FIG. 6, the upper surface of the rib 14 includes only the inclined surface 14*b*.

In this embodiment, the oil pump sprocket (the oil pump driving means) 10 for driving the oil pump is disposed above the shallow bottom surface 6*e* of the oil pan 6 and is positioned at a level higher than an oil surface O reserved in the deep bottom portion 6*d*. Therefore, the oil is not agitated as the oil pump sprocket (the oil pump driving means) 10 rotates, whereby the oil is prevented from bubbling and no air is mixed into the oil.

Even in the case that the oil pump sprocket (the oil pump driving means) 10 is positioned at a lower level than the oil surface O, or is submerged into the oil, it is possible to prevent the oil pump sprocket 10 from agitating the oil and generating the oil bubbling. In such a case, the oil pump housing 7 may be integrally formed with the deep bottom portion 6*d* so as to extend in continuity therewith, without providing the shallow bottom portion 6*e* in the oil pan 6.

Figure 7:
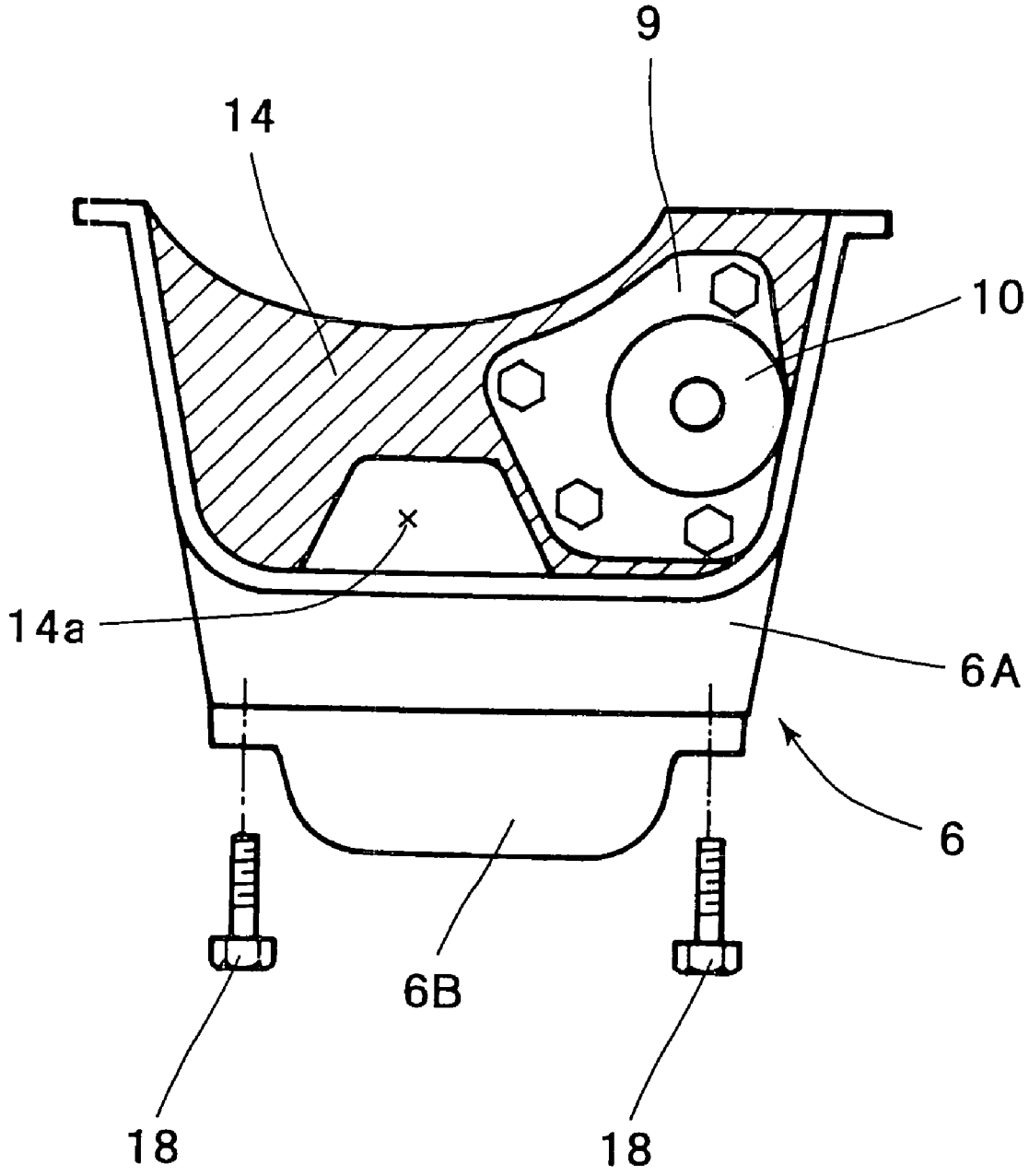
FIG. 7 is a front elevational view of another embodiment in which the oil pan is constituted by an upper oil pan and a lower oil pan.

As shown in FIG. 7, the oil pan 6 may have a two-separated structure comprising an upper oil pan 6A and a lower oil pan 6B. In this case, the lower oil pan 6B is mounted to a lower surface of the upper oil pan 6A by bolts 18; the deep bottom portion 6*d* is formed in the lower oil pan 6B; and the oil pump housing 7 is integrally formed with the upper oil pan 6A.

In this case, the upper oil pan 6A may be integrally formed with the oil pump housing 7 as an aluminum die-cast product, and the lower oil pan 6B may be a press-molded product. Therefore, they can be easily manufactured.

Although the oil pump of the above embodiment is configured as an external gear pump, the oil pump may be the other type of pump, such as an internal gear pump, a trochoid pump.

According to the above embodiment, it is not necessary to mount the oil pump independently to the side surface 1*a* close to the timing chain of the cylinder block 1 as in the conventional structure, and it is not necessary to provide the attachment portion for mounting the oil pump. Therefore, it is possible to reinforce the side surface 1*a* close to the timing chain of the cylinder block 1 by the rib or the like, whereby it is possible to improve the rigidity of the cylinder block 1, and to make the cylinder block 1 compact so as to reduce the weight.

What is claimed is:

1. A structure of an oil pan which is mounted to a lower surface of a cylinder block in order to reserve an oil therewithin, the structure comprising an oil pump housing cast integrally with the oil pan and further comprising an oil pump driving means that is disposed at a higher level than an oil surface reserved within the oil pan or is submerged within the oil, wherein the oil pump housing is integrally formed with an inner side of a side surface located on the side of one end in a width direction of the oil pan, a rib is provided to connect the side surface located on the side of one end and integrally formed with the oil pump housing to a side surface located on the side of the other end, the rib separates an inner side of the oil pan from an outer side arrangement chamber in which the oil pump driving means is disposed, and an opening for communicating the arrangement chamber with the inner side of the oil pan is formed in a lower portion of the rib.

2. The structure as in claim 1, wherein the oil pump driving means is completely submerged within the oil.

3. The structure as in claim 1, wherein an upper surface of the rib includes an inclined surface inclined downwardly from the side of the arrangement chamber toward the inner side of the oil pan.

4. The structure as in claim 3, wherein the upper surface of the rib further includes a visor-shaped portion inclined upward to extend toward the arrangement chamber.

5. The structure as in claim 1, wherein the oil pan is divided into an upper oil pan and a lower oil pan, and the oil pump housing is integrally formed with the upper oil pan.

6. A structure of an oil pan which is mounted to a lower surface of a cylinder block in order to reserve an oil therewithin, the structure comprising an oil pump housing which is cast integrally with an inner side of a side surface located on the side of one end in a width direction of the oil pan, wherein, a rib is provided to connect the side surface located on the side of one end and integrally formed with the oil pump housing to a side surface located on the side of the other end, the rib separates an inner side of the oil pan from an outer side arrangement chamber in which the oil pump driving means is disposed, and an opening for communicating the arrangement chamber with the inner side of the oil pan is formed in a lower portion of the rib.

7. The structure as in claim 6, wherein an upper surface of the rib includes an inclined surface inclined downwardly from the side of the arrangement chamber toward the inner side of the oil pan.

8. The structure as in claim 7, wherein the upper surface of the rib further includes a visor-shaped portion inclined upward to extend toward the arrangement chamber.

* * * * *